US009534367B2

(12) United States Patent
Coronado

(10) Patent No.: US 9,534,367 B2
(45) Date of Patent: Jan. 3, 2017

(54) FLEXIBLE TOILET SEAL AND METHOD

(75) Inventor: Eduardo Coronado, San Pedro Garza Garcia (MX)

(73) Assignee: COFLEX S.A. DE C.V. (MX)

( * ) Notice: Subject to any disclaimer, the term of this patent is extended or adjusted under 35 U.S.C. 154(b) by 701 days.

(21) Appl. No.: 13/602,671

(22) Filed: Sep. 4, 2012

(65) Prior Publication Data

US 2014/0026305 A1 Jan. 30, 2014

(30) Foreign Application Priority Data

Jul. 27, 2012 (MX) ..... MX/f/2012/002307

(51) Int. Cl.
*E03D 11/16* (2006.01)
*E03D 11/17* (2006.01)

(52) U.S. Cl.
CPC ..... *E03D 11/16* (2013.01); *E03D 11/17* (2013.01)

(58) Field of Classification Search
CPC ..... E03D 11/16; E03D 11/17; F16L 17/025; F16L 17/03
USPC ..... 4/252.1–252.6
See application file for complete search history.

(56) References Cited

U.S. PATENT DOCUMENTS

| | | | | |
|---|---|---|---|---|
| 4,827,539 | A | 5/1989 | Kiziah | |
| 6,719,294 | B2 * | 4/2004 | Nguyen et al. | 4/252.5 |
| 6,789,275 | B2 * | 9/2004 | Spells et al. | 4/252.5 |
| 7,805,777 | B2 * | 10/2010 | Hughes | 4/252.4 |
| 2001/0023505 | A1 * | 9/2001 | Atkins | 4/252.6 |
| 2002/0023294 | A1 | 2/2002 | Spells | |
| 2003/0093855 | A1 | 5/2003 | Rendell | |
| 2005/0034227 | A1 | 2/2005 | Cornwall | |
| 2009/0119826 | A1 | 5/2009 | Coronado | |
| 2010/0123307 | A1 | 5/2010 | Coronado | |

OTHER PUBLICATIONS

PCT/IB2013/002187, International Search Report and Written Opinion mailed Mar. 27, 2014.

* cited by examiner

*Primary Examiner* — Tuan N Nguyen
(74) *Attorney, Agent, or Firm* — Baker & McKenzie LLP

(57) ABSTRACT

The present disclosure generally relates to an improved toilet seal and methods for installing such toilet seals. The toilet seal includes one or more rings disposed circumferentially about a sleeve. The rings are removably attached to the sleeve to provide a manner by which to remove one or more of the rings and thereby adjust the position of the seal relative to adjacent piping. The seal further includes a sealing element that includes a flexible lip, which is adapted to deflect downwardly when engaged by a plumbing fixture.

17 Claims, 9 Drawing Sheets

FLEXIBLE TOILET SEAL AND METHOD

CROSS-REFERENCE TO RELATED APPLICATIONS

This application claims priority to Mexican design application MX/f/2012/002307, filed on Jul. 27, 2012, which is hereby incorporated by reference in its entirety.

TECHNICAL FIELD

The present disclosure relates generally to devices for connecting conduits, such as plumbing fixtures to waste drain conduits, and more particularly to a toilet seal, including a flexible sleeve, a sealing element disposed at an end of the sleeve, and a plurality of rings coupled to the sleeve. The toilet seal mounts a water closet (toilet) on a supporting floor surface and also provides a sealed interconnection between a water closet (toilet) and a water waste drain pipe. Related methods for interconnecting conduits are also described.

BACKGROUND

Water closets, also called toilets, are waste disposal devices commonly installed in most bathrooms. These kinds of plumbing appliances generally include a water-storing receptacle called a water tank that is attached to a siphon seat-shaped bowl called a toilet bowl. Periodically, waste is removed from the toilet bowl by flushing, thereby allowing water to drain from the water tank through the toilet bowl and into a waste drainpipe. In order to work, however, the toilet bowl must be connected to the waste drainpipe by fluid carrying conduits. Typically, the toilet bowl will sit flat on a floor and connect with a rigid water closet flange. The water closet flange in turn connects with conduits leading to a waste drainpipe.

Conventional water closet flanges are often used with wax seals that are disposed about a discharge pipe extending from the toilet. Such seals can be unreliable because the seal connection is not strong enough to prevent leakage and associated odors, and oftentimes they can be expensive and inefficient due to delays in the installation process. Also, conventional toilet seals, such as wax seals, are fixed in height and thus may not work in certain situations where the finished floor height is too high or too low to provide an effective seal.

Improved toilet seals for addressing the above-described problems are desired. Related methods for installing improved toilet seals are also desired.

BRIEF SUMMARY

The present disclosure generally relates to an improved toilet seal and methods for installing such toilet seals. In one exemplary embodiment, a toilet seal according to the present disclosure includes a plurality of rings disposed circumferentially about a conduit portion (i.e. sleeve). The toilet seal further includes a sealing element that includes an inwardly extending flexible lip at a terminal end of the sleeve. In some embodiments, the sleeve has a sufficient degree of flexibility to accommodate connection between offset, misaligned, angled, or otherwise incongruous plumbing fixture discharges and waste drainpipe outlets. In other embodiments, the sleeve takes on a more rigid configuration. The inwardly extending flexible lip provides a desired seal between the plumbing fixture discharge and the waste drainpipe, thereby eliminating the need for a separate gasket element, such as a wax seal or rubber foam seal. One or more of the rings disposed about the sleeve are removable to provide for adjustment of the seal in the vertical direction relative to the plumbing fixture discharge and the waste drainpipe outlet. The rings may be removable by hand or tool to provide for such adjustment, and such rings may further be quick-detachable. Such a configuration is particularly advantageous to account for differences in floor height, which may require toilet seals of different sizes.

Related methods for installing the toilet seal between plumbing fixture discharges and waste drainpipes are also described.

BRIEF DESCRIPTION OF THE DRAWINGS

Reference is now made to the following descriptions taken in conjunction with the accompanying drawings.

DETAILED DESCRIPTION

Various aspects of a toilet seal and related methods for installing and adjusting the toilet seal according to the present disclosure are described. It is to be understood, however, that the following explanation is merely exemplary in describing the devices and methods of the present disclosure. Accordingly, several modifications, changes and substitutions are contemplated.

Figure 1A:
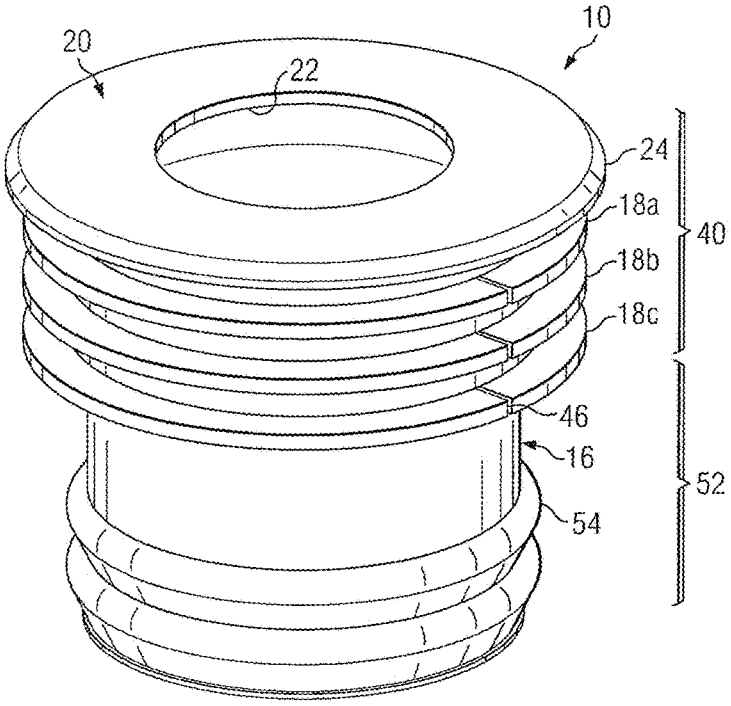
FIG. 1A illustrates an isometric view of one embodiment of a toilet seal according to the present disclosure.
Figure 1C:
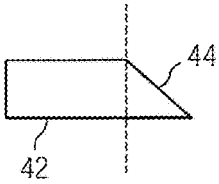
FIG. 1C illustrates a detailed cross-sectional view of the ring of FIGS. 1A and 1B.
Figure 1D:
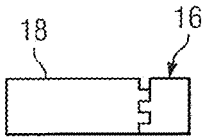
FIG. 1D illustrates an alternative embodiment of a connection between a ring and a sleeve.
Figure 1B:
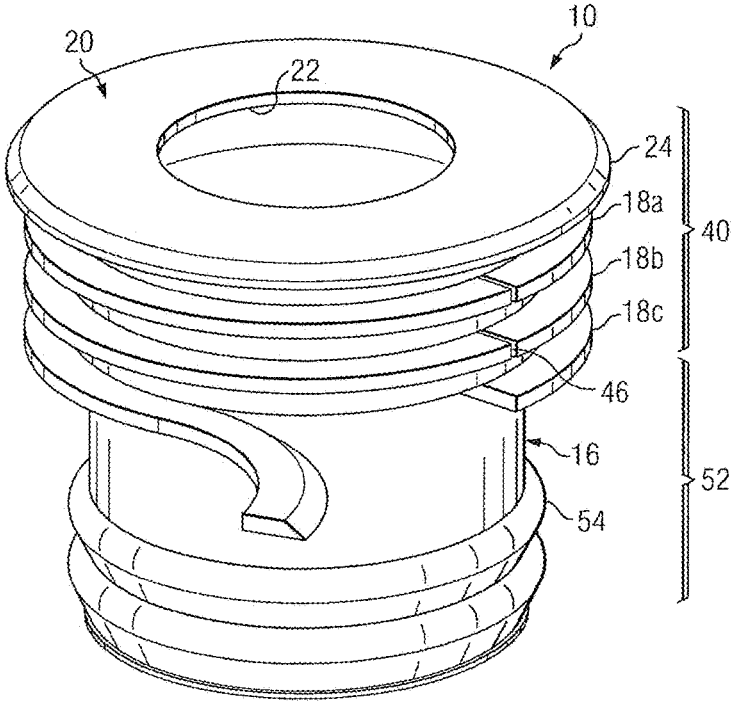
FIG. 1B illustrates the toilet seal of FIG. 1A with a ring partially removed from the seal.
Figure 4:
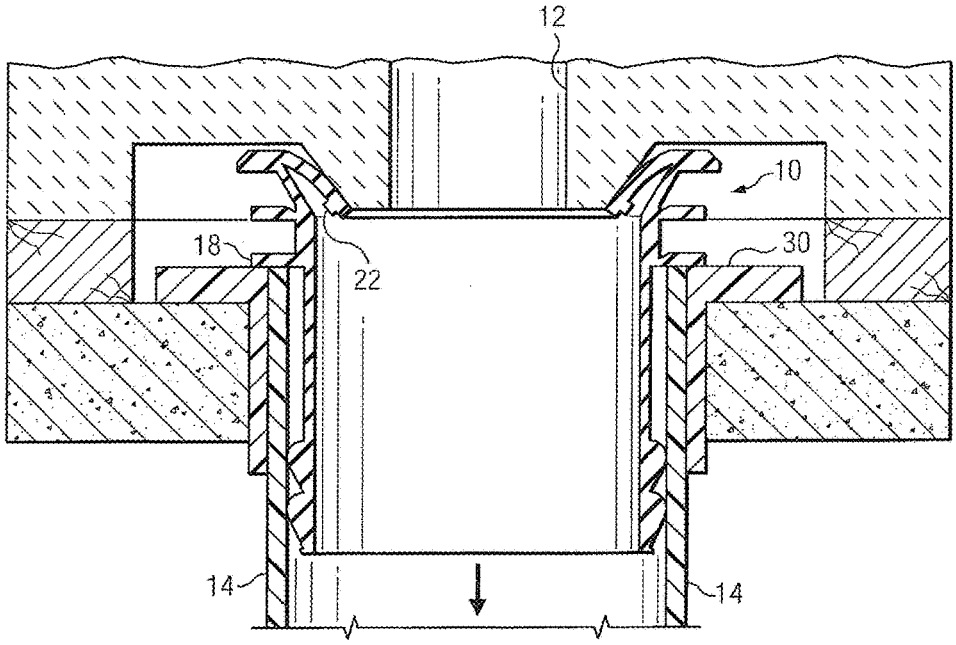
FIG. 4 illustrates a front sectional view of the toilet seal of FIG. 1A partially disposed within a waste drainpipe and adjacent to a toilet flange and having one of the rings removed.

FIGS. 1A, 1B and 4 illustrate a toilet seal 10 for connecting between a plumbing fixture discharge 12 and a waste drainpipe outlet 14. The toilet seal 10 includes a sleeve 16 and a plurality of rings 18*a-c* disposed circumferentially about an upper portion of the sleeve. Although three rings are illustrated, it is to be appreciated that one or more rings may be utilized depending on the size of the sleeve 16. The toilet seal 10 further includes a sealing element 20 disposed at a terminal end of the sleeve 16 to thereby engage and seal a plumbing fixture discharge as will be described. Preferably, the sealing element 20 includes a flexible lip 22, which extends inwardly relative to the circumference of the sleeve 16. The sealing element 20 may further include a ring portion 24 extending beyond the circumference of the sleeve 16 to provide support for the sealing element during modes of use in which removable rings 18*a-c* have been removed from the sleeve.

Figure 2A:
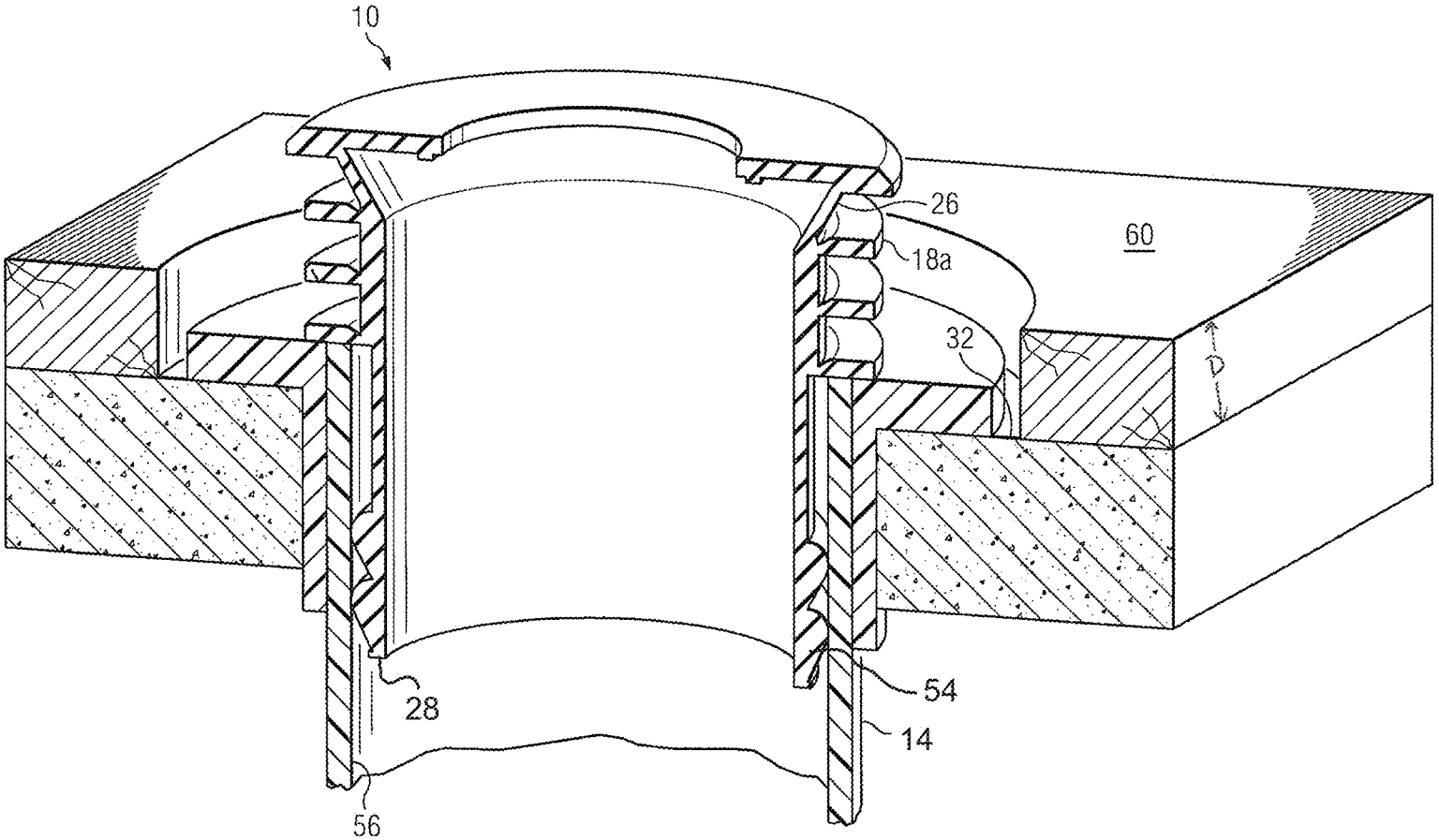
FIG. 2A illustrates an isometric sectional view of the toilet seal of FIG. 1A partially disposed within a waste drainpipe and adjacent to a toilet flange.

Also, in some embodiments, for example as shown in FIG. 2A, a linking portion 26 of the sleeve 16 extends angularly in an outward direction away from the uppermost ring 18*a* and terminates at the sealing element 20. This provides an increased area into which the flexible lip 22 can deflect when in its operative position. Also, the thickness of the ring portion 24 may be greater than the thickness of the flexible lip 22, to thereby provide greater support when engaged with a surface. Of course, other embodiments are contemplated in which the sleeve is substantially uniform (except for additional sealing elements as will be described) from the lip 20 to an opposing terminal end 28 of the sleeve 16.

Figure 2B:
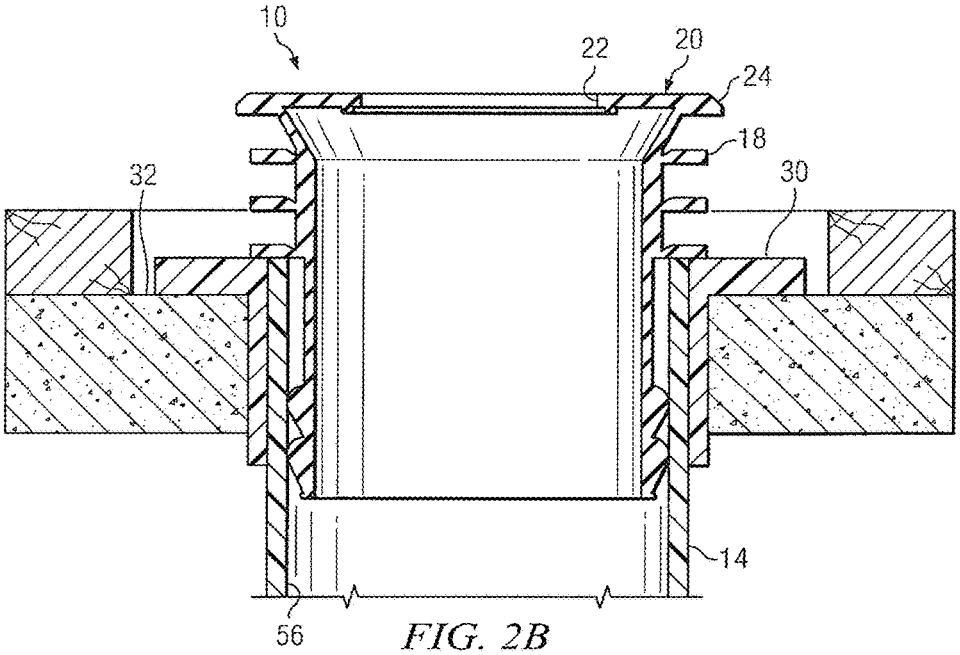
FIG. 2B illustrates a front sectional view of the toilet seal arrangement of FIG. 2A.
Figure 3A:
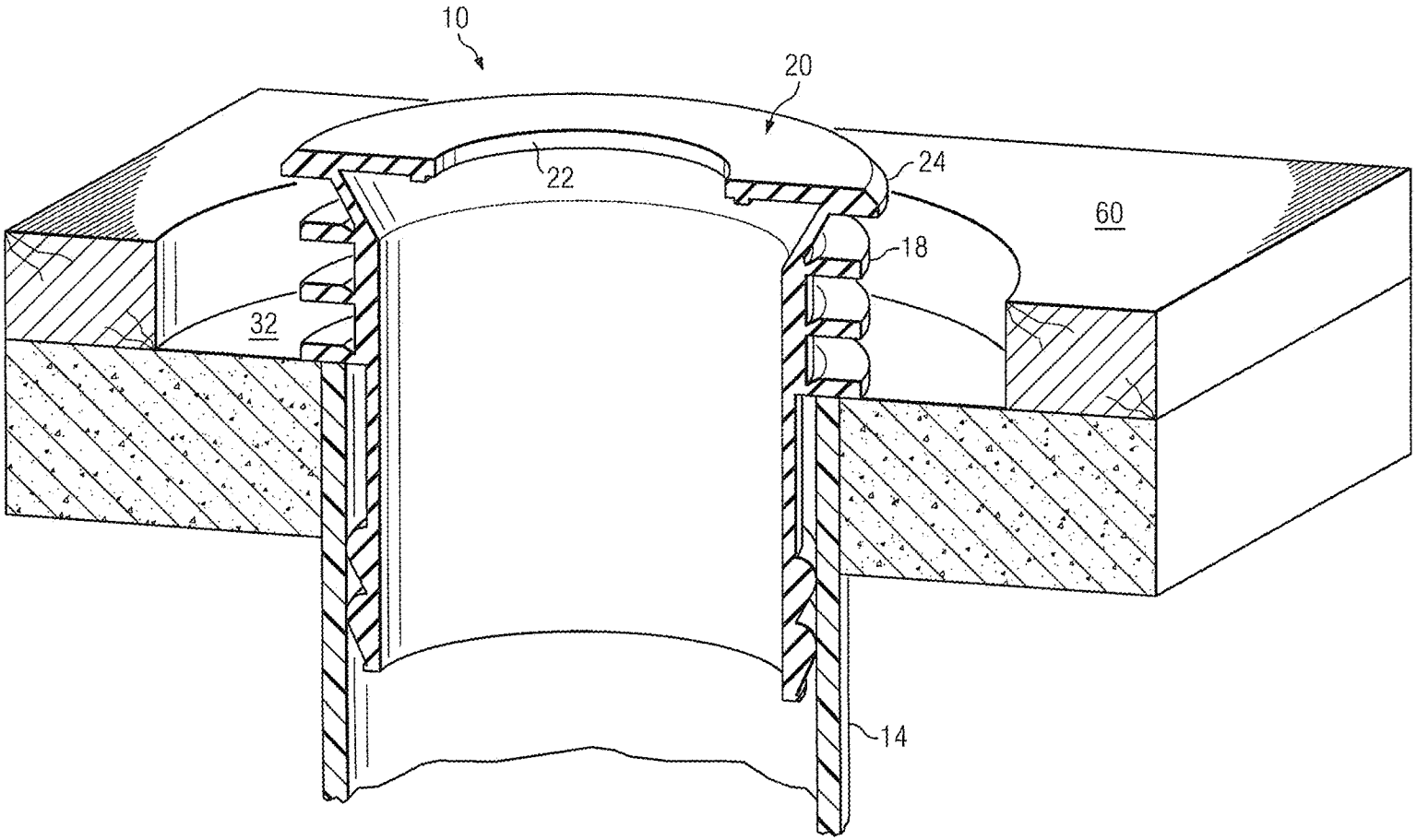
FIG. 3A illustrates an isometric sectional view of the toilet seal of FIG. 1A partially disposed within a waste drainpipe.
Figure 3B:
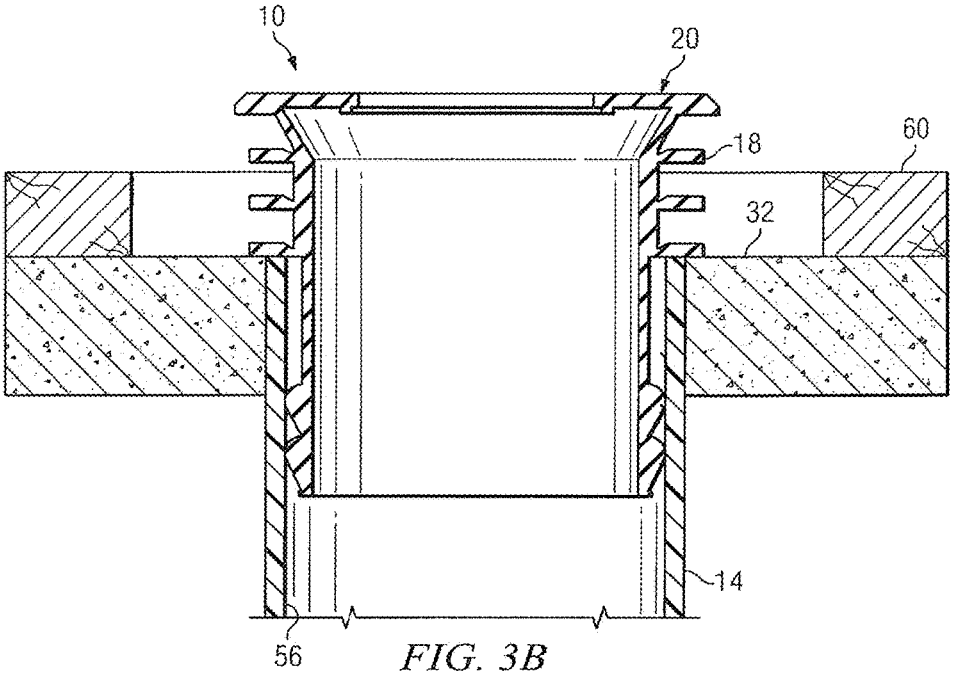
FIG. 3B illustrates a front sectional view of the toilet seal arrangement of FIG. 3A.

In the embodiment of FIGS. 2A and 2B, the toilet seal 10 is further used with a toilet flange 30, which is seated against surface 32. In some embodiments, the seal 10 is integrally formed with the flange 30 as a single piece, while in other embodiments, such as that shown in FIGS. 2A and 2B, the seal and flange are separate elements. The flange 30 may include one or more apertures (not shown) formed therethrough to receive fasteners (not shown) for securing the flange to the surface 32. In other embodiments, such as shown in FIGS. 3A and 3B, the toilet seal 10 may be used without a toilet flange and thus the seal directly engages the surface 32 when connecting between the plumbing fixture discharge 12 (FIG. 4) and the waste drainpipe outlet 14. As illustrated in FIGS. 2A-3B, the sleeve 16 is adapted for disposal within the waste drainpipe outlet 14 as opposed to outside of the drainpipe as is typical with wax seals.

The rings 18 provide a surface of the seal 10 for abutting against the toilet flange 30 (FIGS. 2A and 2B) or the floor surface 32 (FIGS. 3A and 3B), while also providing a manner for adjusting the position of the seal relative to the plumbing fixture discharge 12 (FIG. 4) and waste drainpipe outlet 14. More particularly, the rings 18 are secured to an upper portion 40 (FIG. 1) of the sleeve 16 via a detachable connection, such as a perforated or decreased thickness connection between the ring and the sleeve. For example, with reference to FIGS. 1B and 1C, a portion of lowermost ring 18*c* has been detached from the sleeve 16 to reveal a cross-section having a first region 42 of substantially uniform thickness and a second region 44 of decreasing thickness. Preferably, the region 44 of decreasing thickness is initially secured to the sleeve 16, thus leaving the region 42 of substantially uniform thickness exposed beyond the sleeve. In this manner, the region 42 of substantially uniform thickness is provided to support the toilet seal 10 on the toilet flange 30 (FIGS. 2A and 2B) or surface 32 (FIGS. 3A and 3B). Additional embodiments are contemplated in which the region 42 is not of uniform thickness, but retains a thickness generally greater than region 44. Also, in some embodiments, a portion of region 44 may be exposed along with region 42 and thus only a portion of region 44 is connected to the sleeve 16. In still further embodiments, and with reference to FIG. 1D, the ring 18 is connected to sleeve 16 via a perforated connection. Furthermore, a notch 46 may be formed in the ring 18 to facilitate detachment of the ring from the sleeve. For example, a conventional tool such as a box cutter may be used to cut through the notch 46 to begin the process of removing the ring 18 from the sleeve 16. In other embodiments, the ring 18 may not extend fully around the sleeve 16 and thus may define a gap that facilitates detachment of the ring from the sleeve.

Figure 5A:
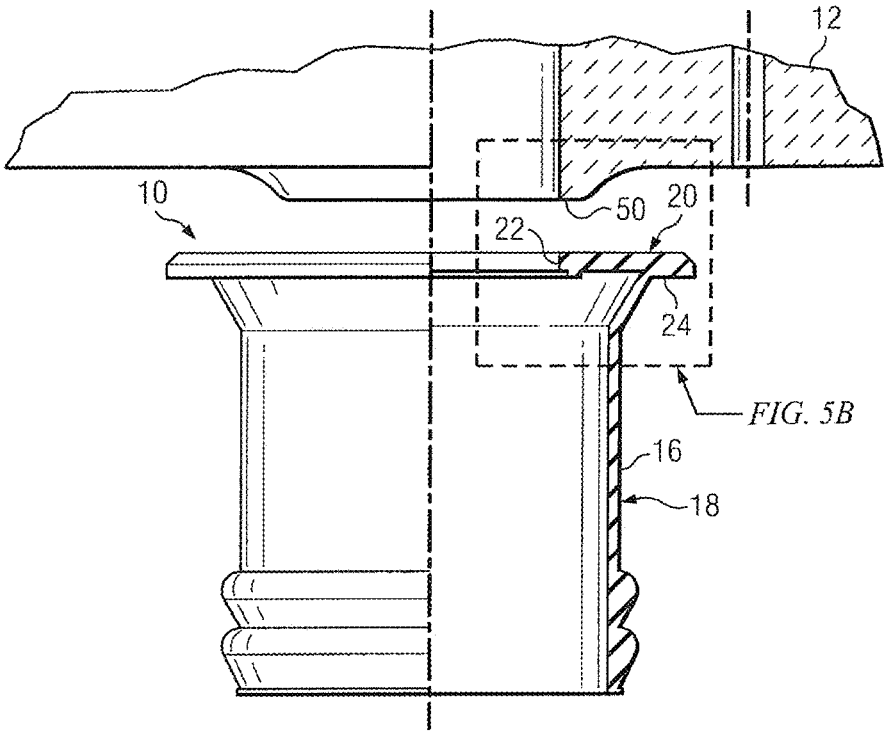
FIG. 5A illustrates a partial sectional, partial elevational view of the toilet seal of FIG. 1A disposed adjacent to a plumbing discharge outlet.
Figure 5B:
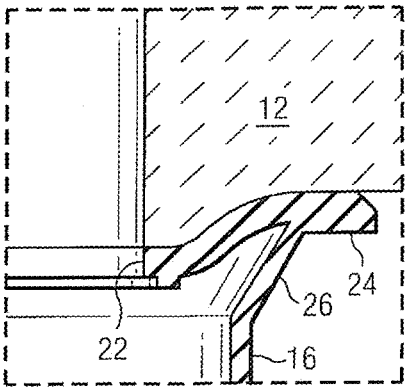
FIG. 5B illustrates a detailed sectional view of the plumbing fixture discharge seated against the toilet seal.

Referring to FIGS. 5A and 5B, the plumbing fixture discharge 12 may be seated against the seal 10 such that an extended portion 50 of the plumbing discharge comes into contact with inwardly-extending lip 22, thereby deflecting the lip downwardly. As shown in FIG. 5B, the inward lip 22 may deflect downwardly relative to the outer portion 24 that extends beyond the diameter of the sleeve 16 and the terminal end of the linking portion 26 when the lip comes into contact with the plumbing fixture discharge 12. The lip 22 provides a tight seal that will prevent gas and fluids from leaking from the interconnection between the plumbing fixture discharge 12 and the waste drainpipe 14 and the seal is sufficient to not break even if the toilet becomes backed up. Moreover, the sealing protection provided by the lip 22 eliminates the need for separate additional elements, such as regular wax seals or foam rubber gaskets.

Referring again to FIGS. 1A and 1B, the sleeve 16 further includes a lower portion 52 generally defined as the portion of the sleeve extending below the lowermost ring 18*c*. One or more sealing elements 54 are disposed circumferentially about the lower portion 52 of the sleeve 16 to provide a seal between the sleeve and an inside surface 56 of the waste drainpipe 14 (FIG. 2A). In some embodiments, the sealing elements 54 form an integral portion of the sleeve 16, and therefore, constitute a region of increased diameter relative to the remaining lower portion 52 of the sleeve. As illustrated in FIGS. 2A-3B, the sealing elements 54 have a maximum diameter at a region generally corresponding to an upper portion thereof, and generally decreases in diameter to a lower portion thereof. In this manner, the sealing elements 54 provide a tight water seal. It is contemplated that the sealing elements 54 may take other shapes so long as they seal the interface between the sleeve 16 and the waste drainpipe 14. For example, the sealing elements 54 may be modified to have a substantially uniform diameter, an increasing diameter from a lower portion to an upper portion, or a varying diameter. In other embodiments, the sealing elements 54 may be separate O-rings.

In one embodiment, the sleeve 16 is made of substantially uniform material, and thus is sufficiently flexible to permit distortion of the lower portion 52 of the sleeve to achieve non-negligible angles of deflection relative to a non-distorted longitudinal axis thereof. In one example, a non-negligible angle of deflection may be ten degrees or more of deflection of one end of the sleeve 16 relative to an opposing end of the sleeve. The sleeve 16 may be formed of various materials to permit non-negligible flexibility. For example, the sleeve 16 may be formed of materials having a hardness ranging from 35 shore A to 90 shore A, or from 35 shore A to 65 shore A, or more specifically about 50 shore A. As can be appreciated, the uniform nature of the sleeve 16 leads to a reduction in manufacturing costs and the likelihood of error during installation. Also, the sleeve 16 may be of any suitable length. In one example, the sleeve 16 is 3-4 inches in length.

In some embodiments, the entire sleeve 16 (including the upper 40 and lower 52 portions) may be formed of material having a greater degree of hardness relative to the previously described embodiments. For example, the hardness of the sleeve 16 may range up to a relatively rigid 120 Rockwell R. In these embodiments, an additional soft sealing element, such as an O-ring, may be added around the lower portion 52 and a seal or soft plastic material may be added adjacent to the lip 22.

In practice, the toilet seal 10 is used to connect a plumbing fixture discharge, such as the distal portion of a toilet, to a waste drainpipe, such as a sewage line. In facilitating this connection, the toilet seal 10 provides a tight seal and reliable connection to prevent any undue leakage or other undesirable consequence of the connection. During installation, the toilet seal 10 may be seated against a surface disposed between a plumbing fixture discharge and a waste drainpipe, such as an unfinished floor surface 60 (FIG. 3A). In some embodiments, the toilet seal 10 may be used with a toilet flange 30 (FIGS. 2A and 2B), which is disposed between the toilet seal 20 and the surface 32 of an unfinished floor surface as shown in FIGS. 2A and 2B. Oftentimes, the thickness D (FIG. 2A) of a finished floor surface 60 will vary from location to location, which will thus vary the distance between the plumbing fixture discharge 12 and the waste drainpipe outlet 14. It is therefore difficult to ascertain the appropriately sized toilet seal 10 to apply in any particular job as the distance will vary between the plumbing fixture discharge 12 and the waste drainpipe 14. However, the teachings of the present disclosure overcome such problems by providing for a way to adjust the position of the toilet seal 10 relative to the plumbing fixture discharge 12 and the waste drainpipe 14, thus accommodating various distances therebetween.

For example, with reference to FIG. 2B, the toilet seal 10 may be used without removing any of the rings 18 originally disposed around the sleeve 16. However, with reference to FIG. 4, other situations may call for removal of the lowermost ring 18*c* to accommodate for a decreased distance between the plumbing fixture discharge 12 and the waste drainpipe 14. Accordingly, the lowermost ring 18*c* may be removed manually or through use of a tool to thereby adjust the position of the toilet seal 10 relative to the plumbing fixture discharge 12 and the waste drainpipe 14. That is, removal of the lowermost ring 18*c* will allow the toilet seal 10 to translate deeper into the waste drainpipe 14 in the direction indicated by the arrow in FIG. 4. Should additional adjustment be desired, additional rings 18 may be removed to accommodate such adjustment.

Figure 6A:
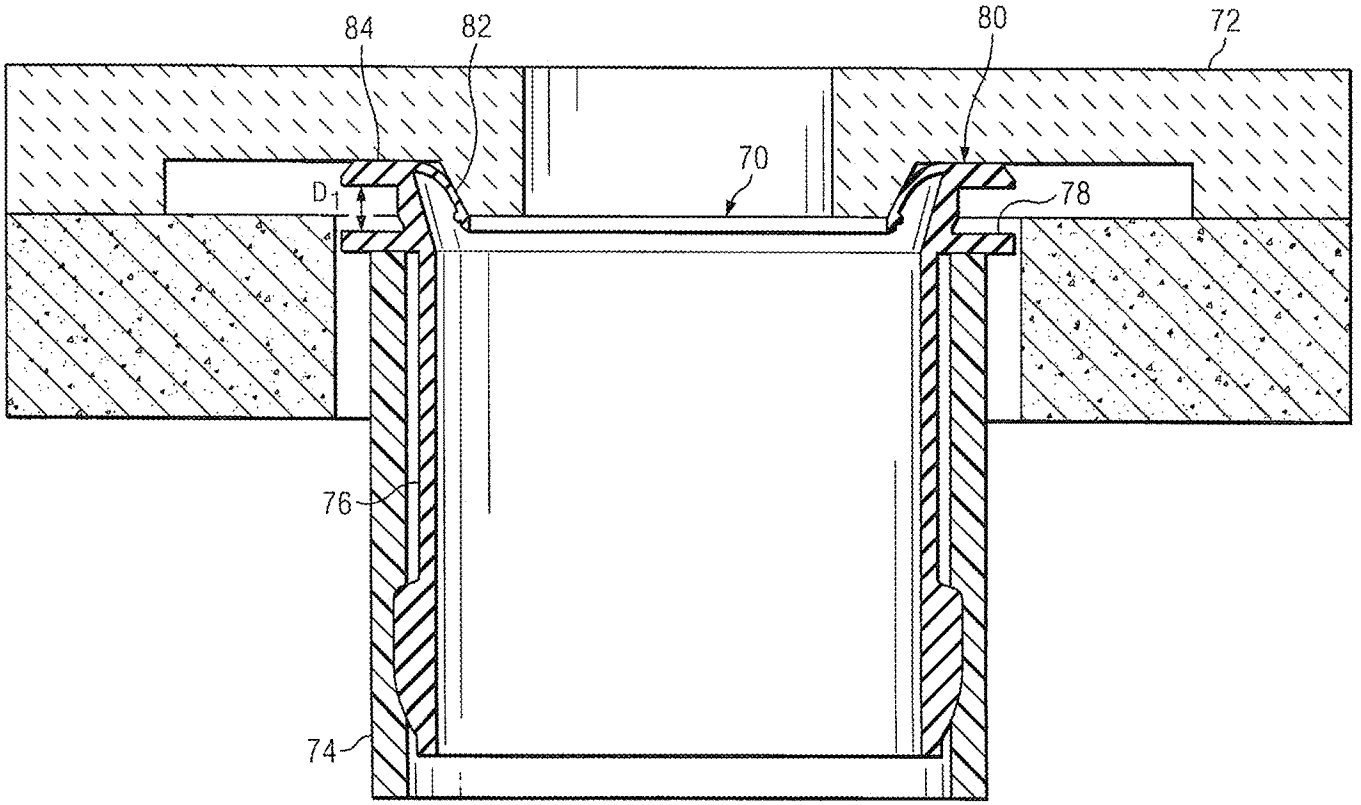
FIG. 6A illustrates a partial sectional, partial elevational view of an alternative toilet seal according to the present disclosure.
Figure 6B:
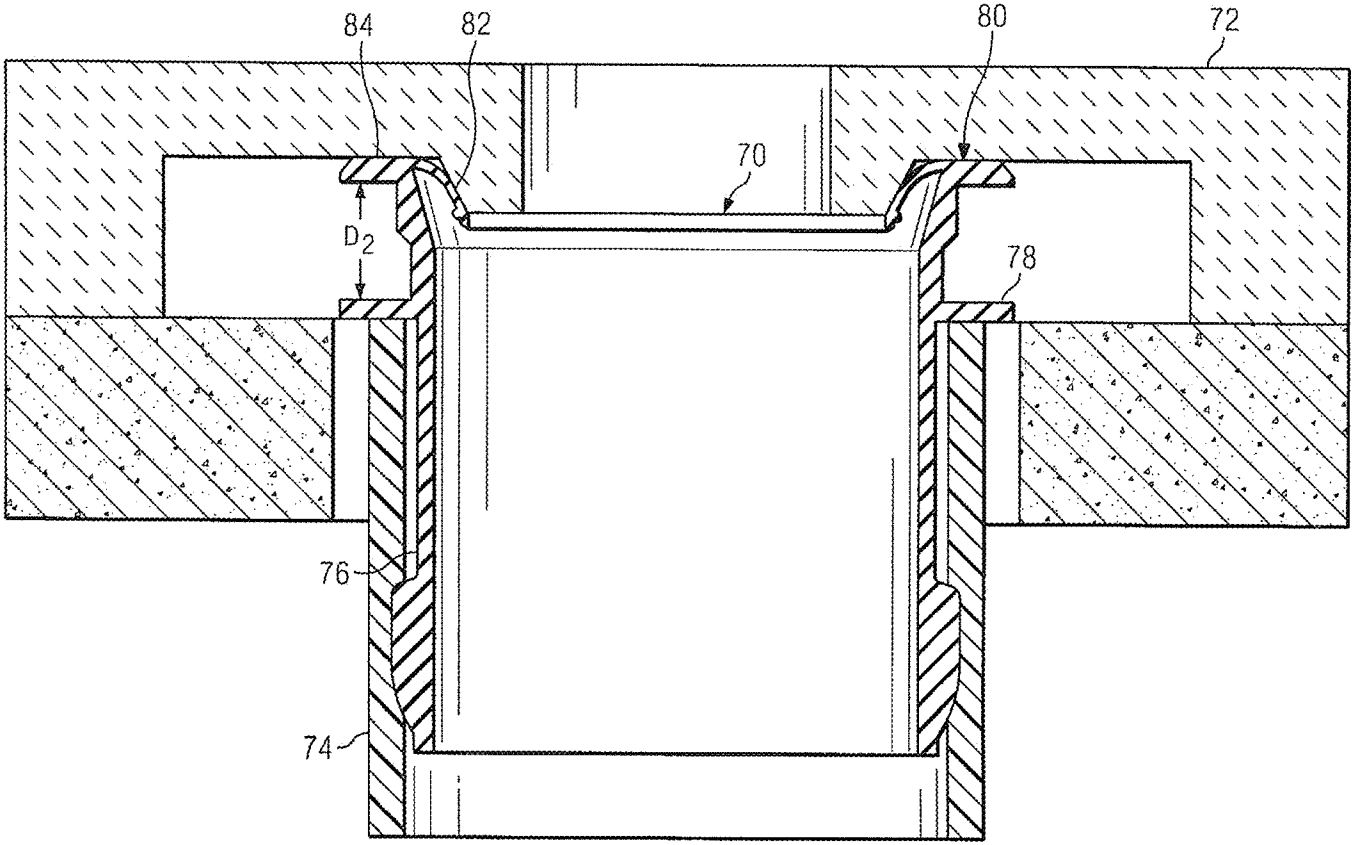
FIG. 6B illustrates a partial sectional, partial elevational view of an alternative toilet seal according to the present disclosure.
Figure 6C:
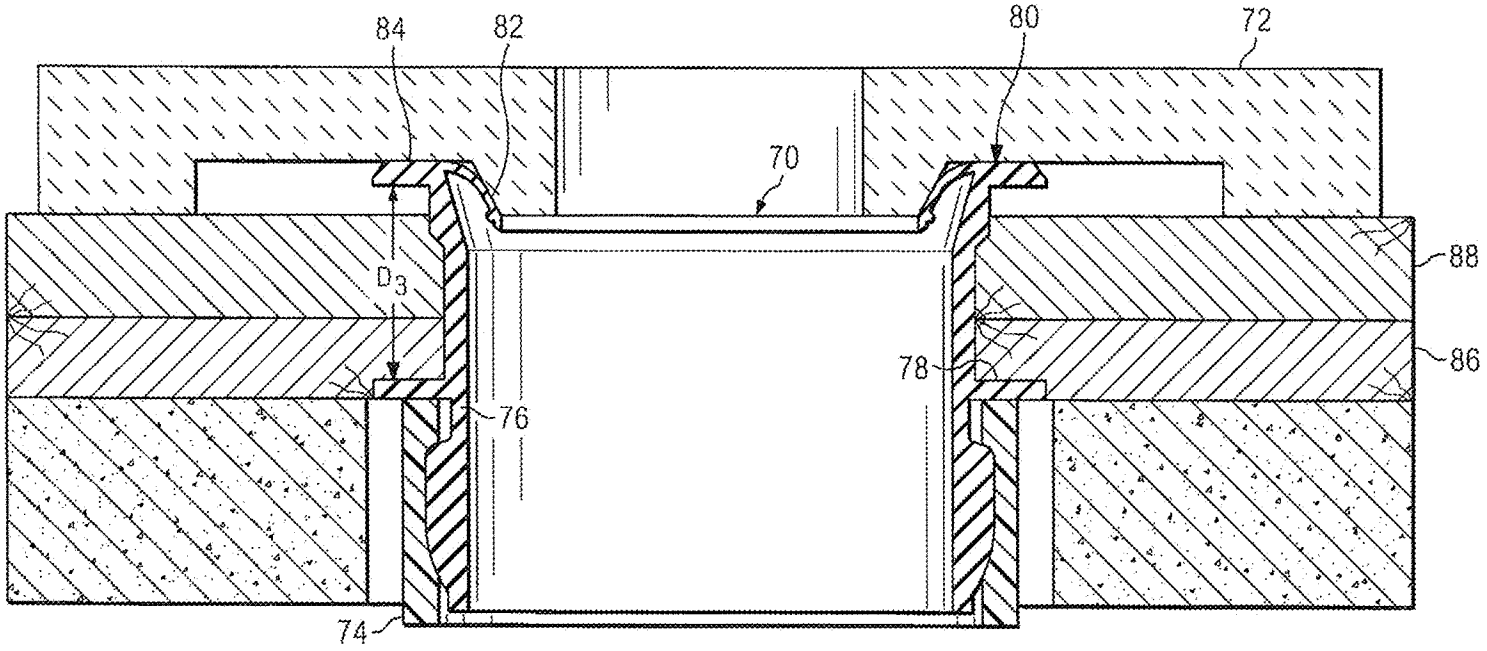
FIG. 6C illustrates a partial sectional, partial elevational view of an alternative toilet seal according to the present disclosure.

In other embodiments, a toilet seal having a fixed ring disposed about a sleeve may be used to seal between a plumbing fixture discharge and a waste drainpipe outlet. For example, referring to FIG. 6A, a toilet seal 70 for connecting between a plumbing fixture discharge 72 and a waste drainpipe outlet 74 includes a sleeve 76 substantially similar to sleeve 16, except that sleeve 76 includes a non-removable, fixed ring 78 disposed thereabout. In the context of the present disclosure, "fixed" means that the ring is not connected to the sleeve in such a way that facilitates detachment of the ring from the sleeve. The toilet seal 70 further includes a sealing element 80, substantially similar to that of sealing element 20 in that it includes an inwardly extending flexible lip 82 and a ring portion 84 extending beyond the circumference of the sleeve 76. The ring 78 is spaced a short distance $D_1$ from the ring portion 84 of the sealing element 80. Other embodiments of the toilet seal 70 may include a fixed ring at another location along the sleeve 76. For example, referring to FIG. 6B, the fixed ring 78 is disposed at a lower position around the sleeve 76 relative to the embodiment of FIG. 6A and thus is spaced a distance $D_2$ from the ring portion 84, wherein $D_2$ is greater than $D_1$. Still further, referring to FIG. 6C, a distance $D_3$ between the ring 78 and the ring portion 84 may be even greater to accommodate embodiments in which, for example, the toilet seal 70 needs to span double flooring 86, 88. In this manner, the toilet seal 70 may take on a variety of configurations in which the fixed ring 78 is located at different positions along the length of the sleeve 76 to thereby accommodate various differences in height between the objects for sealing. In addition to accommodating such different heights, the embodiments of FIGS. 6A-6C are also advantageous as material typically included between rings has been removed, thus saving costs associated with material supply.

While various embodiments of a toilet seal and related methods of installing the toilet seal between plumbing fixture discharges and waste drainpipes have been described above, it should be understood that they have been presented by way of example only, and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention (s), and their equivalents, that are protected thereby. In all instances, the scope of the claims shall be considered on their own merits in light of the specification, but should not be constrained by the headings set forth herein.

What is claimed is:

1. A seal for connecting between a plumbing fixture discharge and a waste drainpipe outlet, comprising:

a flexible sleeve made from a material that permits a non-negligible angle of deflection of a lower portion of the sleeve relative to an upper portion of the sleeve;

a sealing element coupled to the upper portion of the sleeve, the sealing element including an inwardly extending flexible lip and an outwardly extending ring portion; and an outwardly extending fixed ring disposed circumferentially about the sleeve and disposed a distance from the ring portion of the sealing element operable to rest on a supporting surface to accommodate differences in height between objects for sealing, wherein the ring has a region of uniform thickness extending orthogonal to a central axis of the sleeve, and the ring is integrally formed with the sleeve.

2. The seal according to claim 1, wherein the region of uniform thickness is spaced from the sleeve.

3. The seal according to claim 1, wherein the ring is disposed incompletely about the sleeve so as to contain a gap.

4. The seal according to claim 1, further comprising a second ring disposed circumferentially about the sleeve and spaced from the ring portion of the sealing element.

5. The seal according to claim 1, wherein the ring has a region of decreasing thickness, and wherein the ring is attached to the sleeve at a region of decreasing thickness.

6. The seal according to claim 1, wherein the ring includes a notch formed therein.

7. The seal according to claim 1, wherein the seal includes another sealing element disposed at the lower portion of the sleeve.

8. The seal according to claim 7, wherein the another sealing element is integrally formed with the sleeve.

9. The seal according to claim 7, wherein the another sealing element is a separate element not integrally formed with the sleeve.

10. The seal according to claim 7, wherein the another sealing element is an O-ring.

11. The seal according to claim 7, wherein an outer diameter of the ring is greater than an outer diameter of the another sealing element.

12. The seal according to claim 1, wherein the seal is adjustable in a longitudinal direction.

13. The seal according to claim 1, wherein the ring does not extend fully around the sleeve so as to define a gap.

14. The seal according to claim 1, wherein the outwardly extending fixed ring is spaced from the outwardly extending ring portion of the sealing element in a longitudinal direction.

15. A toilet sealing assembly for connecting between a plumbing fixture discharge and a waste drainpipe outlet, comprising:

the seal of claim 1; and a flange member disposed about the seal, the flange member adapted for engaging a surface.

16. The seal according to claim 1, wherein the sleeve is capable of forming an angle of deflection between a longitudinal axis of the lower portion and a longitudinal axis of the upper portion of at least 10 degrees.

17. The seal according to claim 1, further comprising the waste drainpipe outlet, wherein an outer diameter of the ring is greater than an inner diameter of the waste drainpipe outlet.

* * * * *